US006283081B1

(12) United States Patent
Ozeki

(10) Patent No.: US 6,283,081 B1
(45) **Date of Patent: *Sep. 4, 2001**

(54) CYLINDER STRUCTURE OF INTERNAL COMBUSTION ENGINE

(75) Inventor: Hisashi Ozeki, Hamamatsu (JP)

(73) Assignee: Suzuki Motor Corporation, Shizouka-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/013,057

(22) Filed: Jan. 26, 1998

(30) Foreign Application Priority Data

Jan. 31, 1997 (JP) ..... 9-033068

(51) Int. Cl.[7] ..... F02F 1/00
(52) U.S. Cl. ..... 123/193.2; 123/193.3
(58) Field of Search ..... 123/193.3, 193.2, 123/41.17, 41.28

(56) References Cited

U.S. PATENT DOCUMENTS

| | | | | |
|---|---|---|---|---|
| 2,127,825 | * | 8/1938 | Mader | 123/193.5 |
| 3,521,607 | * | 7/1970 | Wiseman et al. | 123/193.3 |
| 3,659,568 | * | 5/1972 | Howe | 123/193.3 |
| 3,842,718 | * | 10/1974 | Malchow | 123/193.2 |
| 4,638,769 | * | 1/1987 | Balheimer | 123/193.2 |
| 4,848,292 | * | 7/1989 | Holtzberg | 123/193.3 |
| 5,598,818 | * | 2/1997 | Domanchuk | 123/193.2 |
| 5,727,512 | * | 3/1998 | Hutchins | 123/193.3 |

* cited by examiner

*Primary Examiner*—Marguerite McMahon
(74) *Attorney, Agent, or Firm*—Nath & Associates PLLC; Gary M. Nath; Marvin C. Berkowitz

(57) ABSTRACT

In a combustion internal engine in which a cylinder head 8 is connected to a cylinder block 1 with a bolt 5 coming rough the cylinder head 8, more than half of a screw portion C of the bolt to be screwed in the cylinder block 1 is located under the central portion X of the depth of a water jacket 4. Since this portion of the cylinder block 1 is high in rigidity compared with the upper portion of the cylinder block, a gasket 9 can be tightened evenly.

1 Claim, 6 Drawing Sheets

CYLINDER STRUCTURE OF INTERNAL COMBUSTION ENGINE

SPECIFICATION

A cylinder structure of internal combustion engine

1. Technical Field

This invention relates to a cylinder structure of an internal combustion engine for use of such as automobile.

2. Background of the Arts

FIG. 3 shows a deck surface (plan view) of a cylinder block 1, and a sectional view taken along with A—A line of FIG. 3 is shown in the left side from a center line (a) in FIGS. 1, 2 and 4, and a sectional view taken along with B—B line of FIG. 3 is shown in the right side from the center line (a) in the same FIGS.

In FIG, 3, reference numeral 2 shows a liner (a cylinder liner, or a sleeve), 3 designates a cylinder bore, 4 designates a water jacket, 5 designates head bolts which fasten a cylinder head (hereinafter referred as "bolts") and 6 designates an oil passage. As to bolts, a plurality of bolts 5 are provided spacing each other at a given spacing.

This cylinder block 1 is of a siamese type, in which each barrel 7 (see FIGS. 1, 2 and 3) of the cylinder block is connected each other, from view point of the structural feature, it is said that the rigidity around the area below a water jacket is high. As shown in FIG. 1 and so on, the liner 2 is pressed in the barrel 7, with which a cooling water touches directly. This is a kind of a wet liner type of cylinder block, in which the barrel 7 covers a portion (lower circumference) of the liner 2, which does not touch with the cooling water directly and is called as a dry liner type of cylinder block, so that, it can be called precisely a semi-wet liner type of cylinder block.

Hereinafter, based on FIG. 4 a conventional cylinder structure is explained. 1 designates a cylinder block, 8 designates a cylinder head and 9 designates a lower case of a crank case. A gasket 9 is interposed between the cylinder block 1 and the cylinder head 8. The cylinder head 8 is fastened to the cylinder block 1 due to a bolt 5 coming through a coming through hole 10 of the cylinder head 8 and being screwed in a screw hole 11 provided in the cylinder block 1. And, in the area located in the portion of the right side of the center line (a), a location of the barrel 7 corresponds to the deepest portion of the water jacket 4.

An area of the lower case 9, which is mounted on the cylinder block 1, is connected due to the bolt 13 coming through a bolt through hole 12 provided in the lower case 9 and being screwed in a screw hole 14 provided in the cylinder block 1. 15 designates a crank shaft, 16 designates a main gallery, 17 designates a wall of a blow by gas passage and 18 designates a hole communicating the cylinder block 1 and the water jacket of the cylinder head 8.

In the structure thus formed, the position, at which the screw position C of the bolt 5 is located, is located at an upper position of the cylinder block 1. Since it is located near the upper face (deck surface) of the cylinder block 1 and also located near the water jacket 4, the rigidity is low compared with the area of a central and lower portion of the cylinder block 1, so that a large force is stressed on the area on which the bolt 5 is tightened. As a result, the area between the bolt 5 and another adjacent bolt 5 provided at a given spacing the first bolt 5 becomes small in a compacting rate of a gasket 9 to cause a compacting unevenness, thereby there have been threatened for cooling water, lubricant oil or combustion gas to be leaked from the gasket 9 portion. So that, in order to prevent from being leaked, an expensive gasket had to be used.

Further, since the portion to be tightened with the bolt 5 is acted by a force greater than other portions, a cylinder bore 3 in the vicinity of the screw portion of the bolt 5 is shrank in its diameter as shown in FIG. 6 at upper position ①, and further a deformation from a circle to a non-circle is generated, which causes a lower position ② to be likely to have a tendency to be swelled in its diameter. In addition, the bore 3 not only shrinks in diameter or widens but also the center position (a center line is omitted) is happened to be displaced comparing the upper portion with the lower portion. Then, in order to avoid such deformation, as a counter measure a selection of the material or an increase in thickness has been considered.

For reference, FIG. 6 shows an illustration emphasized in the mode of deformation by taking the unit of vertical dimension larger than the one of horizontal dimension, so that, the actual deformation of the cylinder bore 3 does not occur as shown.

As prior arts showing in the similar technical field, there are Japanese Patent Laid-open Publication No. Hei 8-21299 and Japanese Utility Model Laid-open Publication No. Hei 4-103245. In the former, a bolt is adapted to be screwed in a cylinder liner block to be die-cast in an aluminum alloy cylinder block, and in the latter, a lib is provided so as to connect the wall of each of cylinder bores and the outer wall of the cylinder block around each cylinder, then the bolt screw portion to tighten a cylinder head to the cylinder block is adapted to correspond to the lib. The techniques disclosed in these publications attain the pre-determined object respectively.

The present invention is to provide the structure having the constitution differed from said prior art, which is not affected by tightening the cylinder head to the cylinder block with bolts.

The present invention, as a means to solve the above problem, according to claim 1, in an internal combustion engine, wherein a cylinder block and a cylinder head are connected with a bolt coming through the cylinder head, the means is characterized in that a part more than half of a screw portion of the bolt, which is screwed in the cylinder block, is adapted to be located under the area lower than the center portion of a water jacket.

The invention according to claim 2, wherein a liner is further provided inside a cylinder bore and said water jacket is provided outside the liner provided on a cylinder bore.

EMBODIMENT

Figure 1:
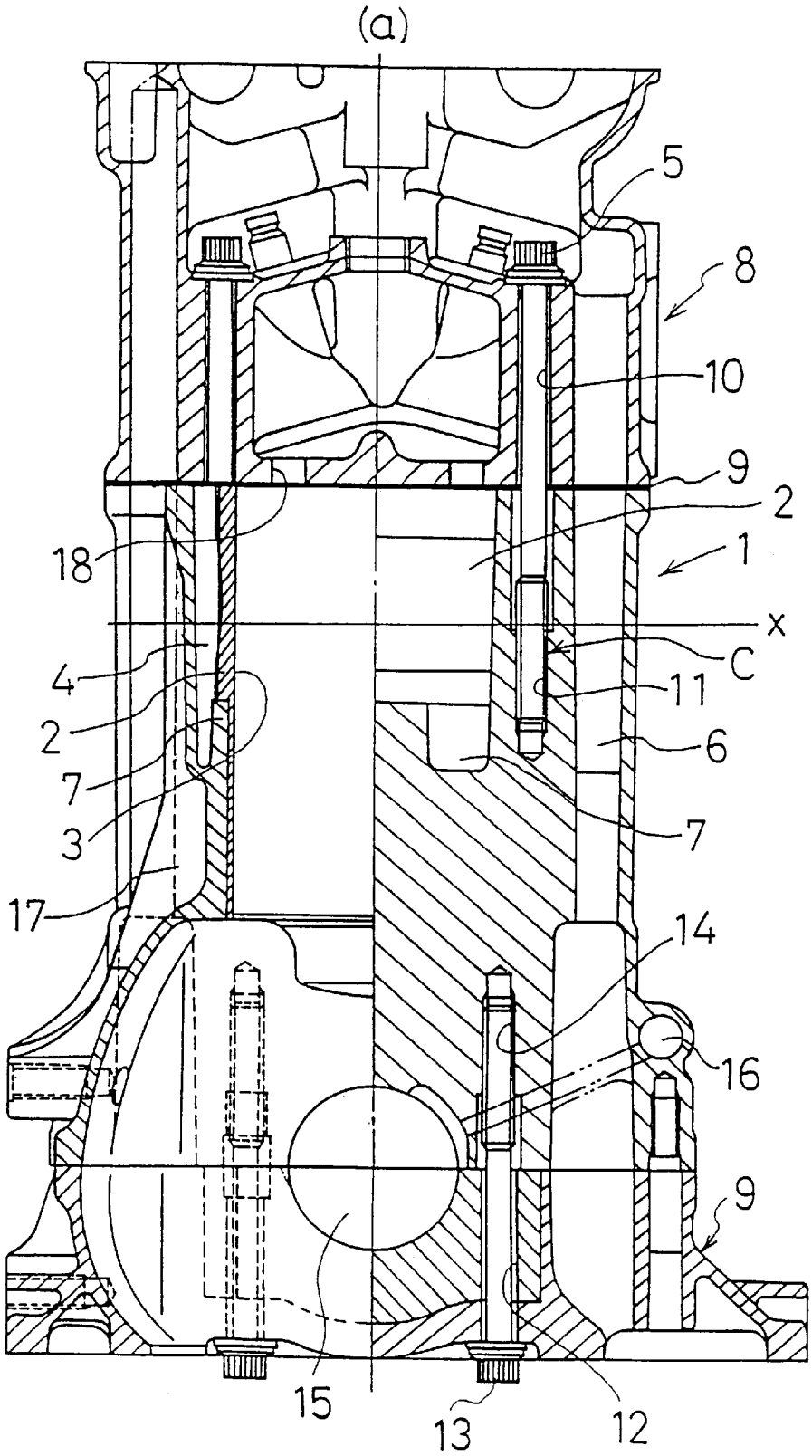
FIG. 1 is a vertically sectional view of an embodiment of the present invention.
Figure 4:
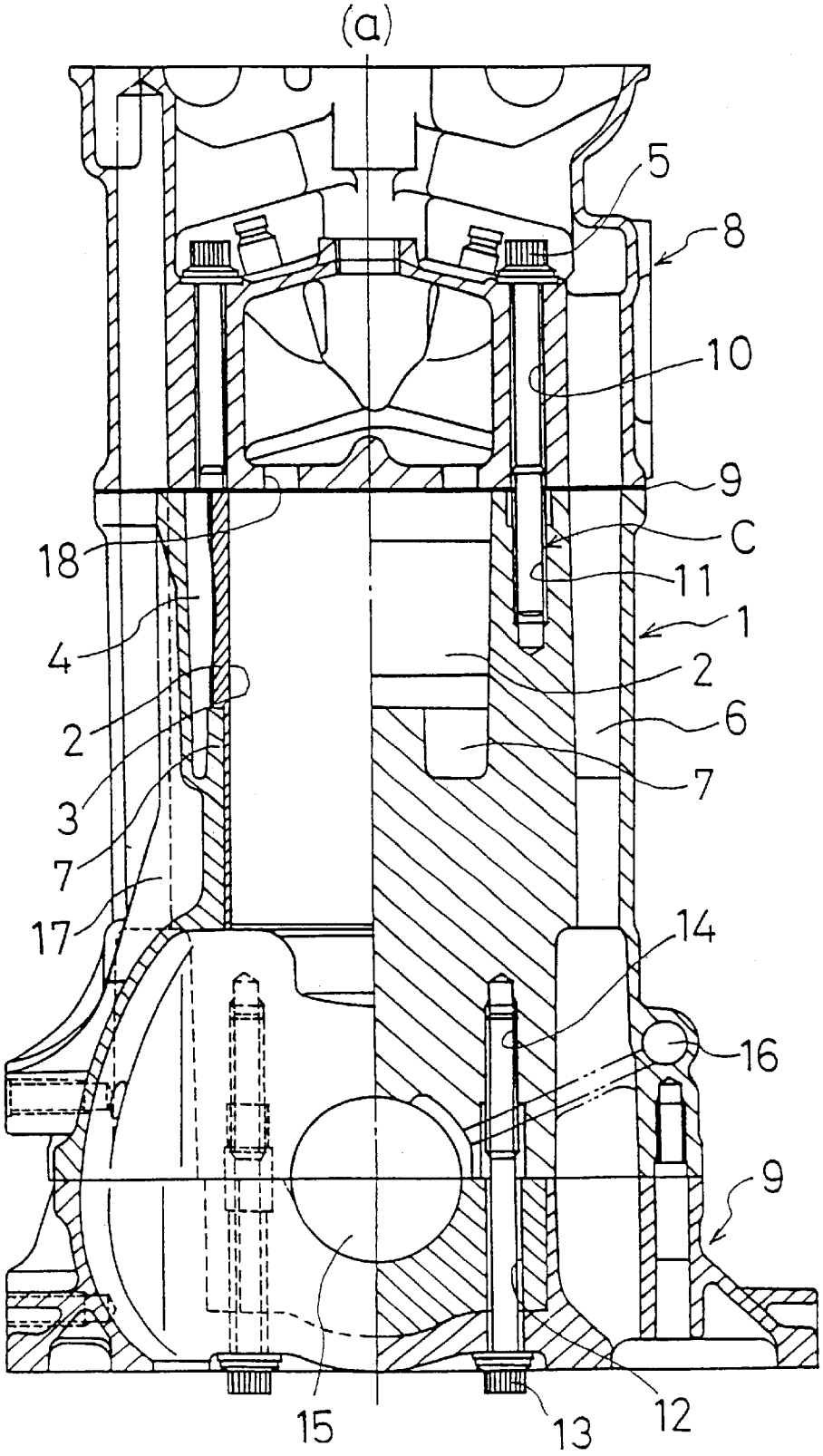
FIG. 4 is a vertically sectional view of a conventional structure by showing the portion same as FIG. 1.

Hereinafter, an embodiment of the present invention is explained based on FIG. 1 designating identical parts of FIG. 4 in identical signs.

In this embodiment, a screw portion C of the bolt 5 (portion of screw hole 11) to the cylinder block 1 is located at the area, where a part of more than half of the screw portion C is located in such a manner as it is located under the center X of the depth of the water jacket. And this position setting is determined so as to set the screw position C of the bolt 5 to be located to the water jacket 4 provided outside the liner 2.

By thus setting the screw portion C of the bolt 5, since it is adapted to be located near at the location where a lower case 9 is connected to the cylinder block 1 with a bolt 13, the wall 17 of the blow by gas passage is located outside the area where the bolt 5 is come through and a barrel 7 for the liner is provided, which in addition is connected between each cylinder, the screw portion C of the bolt 5 is adapted to be screwed in an area having a sufficient rigidity. As a result, while tightening the bolt 5, the gasket 9 is adapted to be compressed by the whole of the cylinder block 1.

Figure 2:
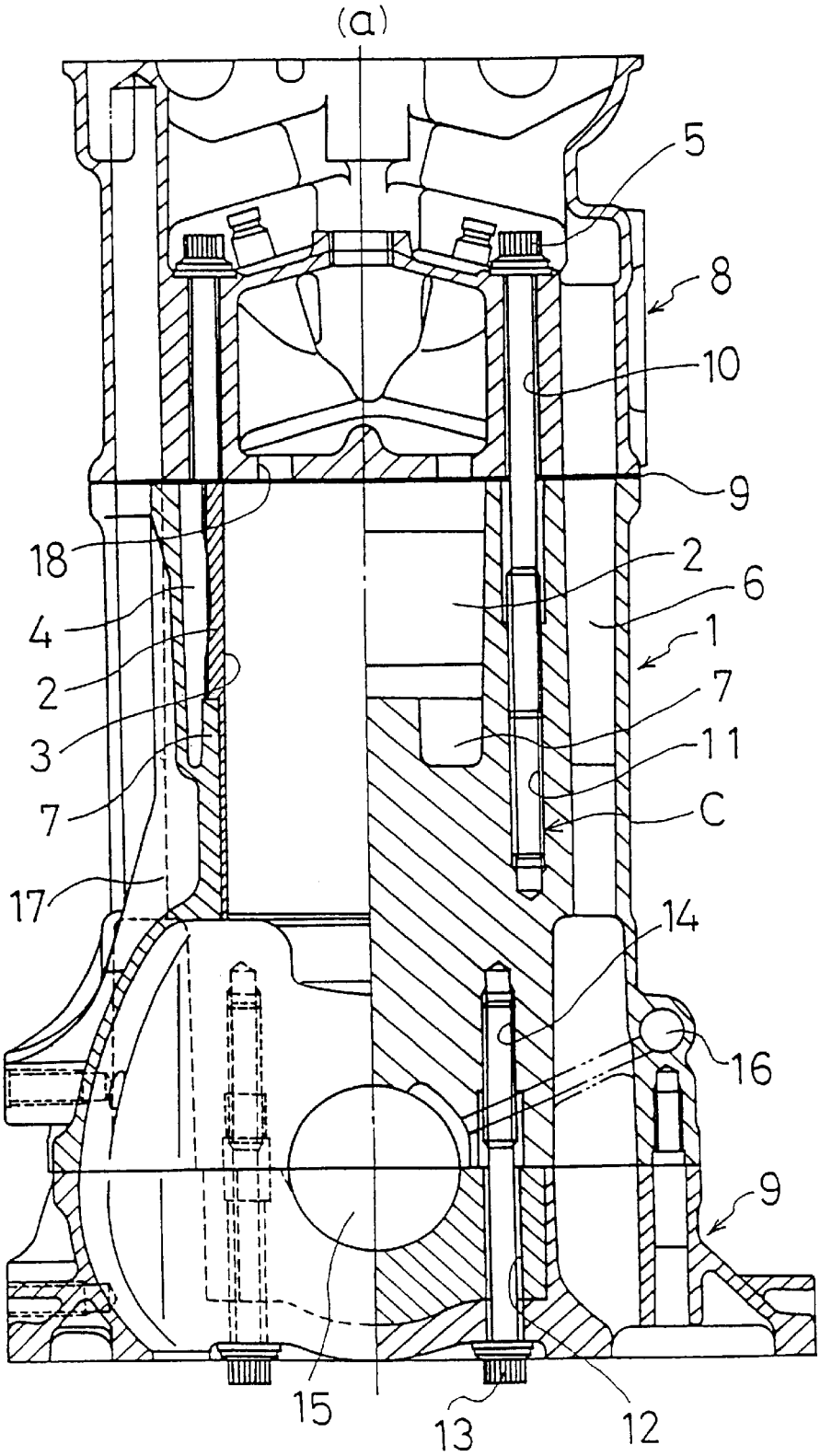
FIG. 2 is a vertically sectional view of another embodiment of the present invention.
Figure 3:
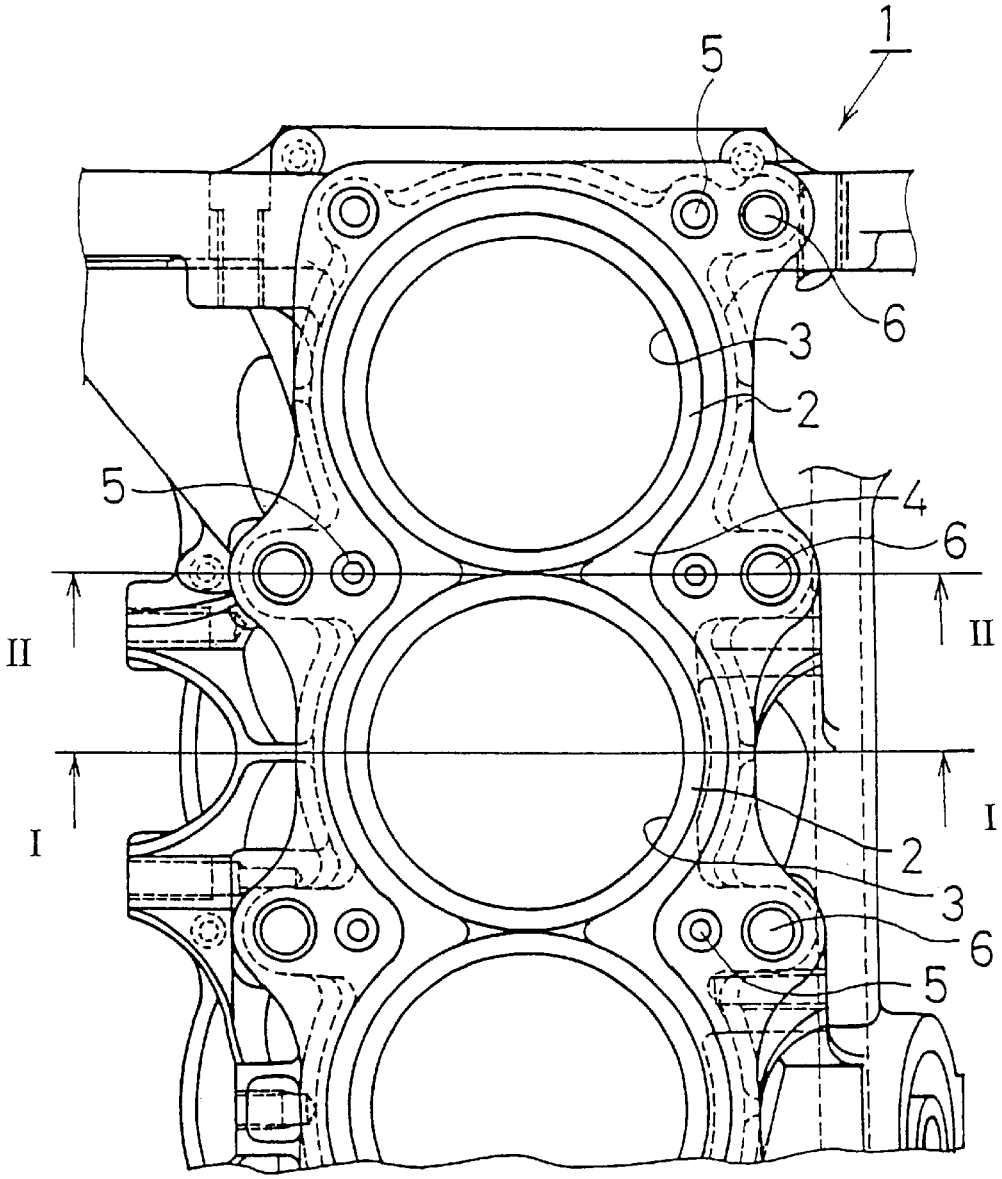
FIG. 3 is a plan view of the upper surface of the cylinder block.
Figure 5:
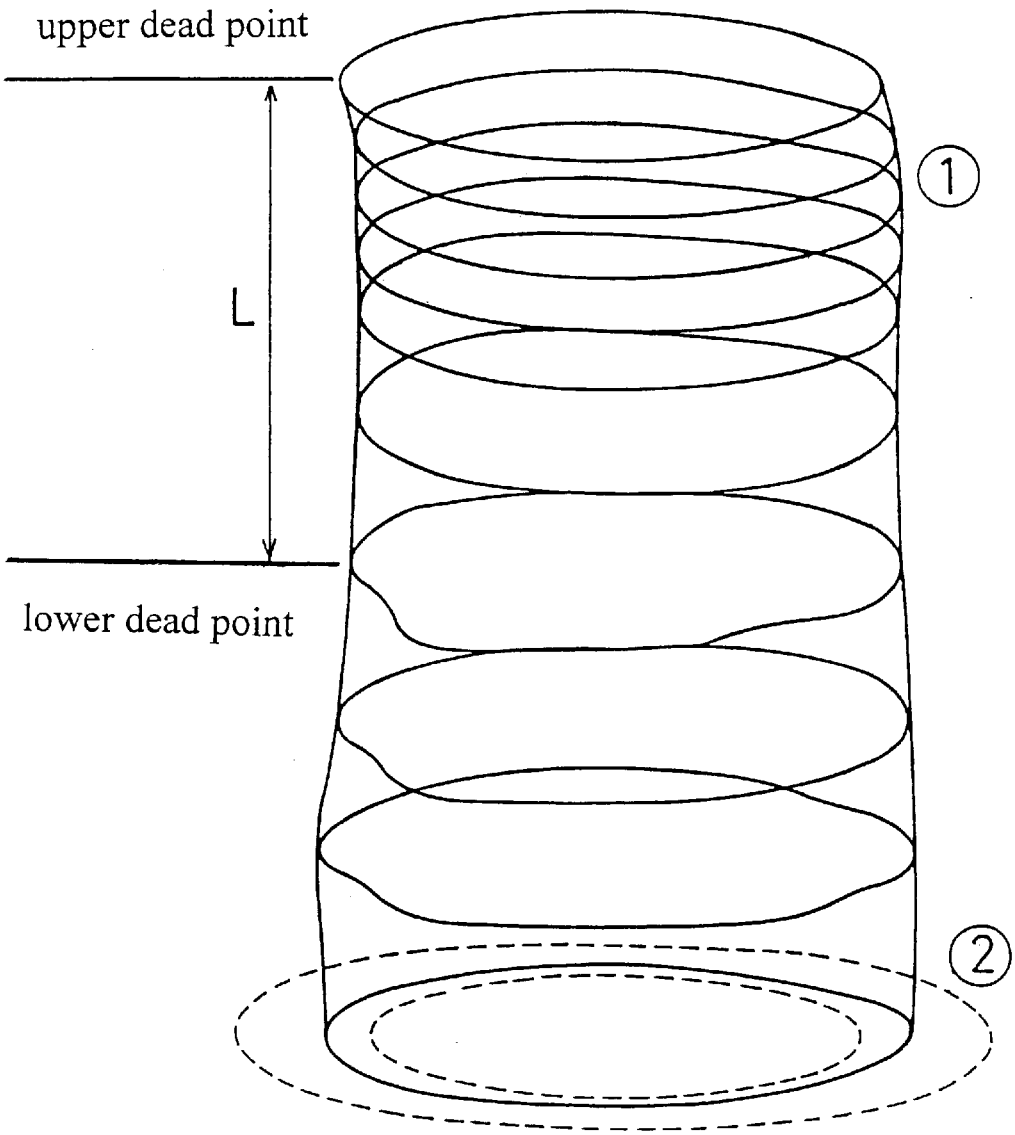
FIG. 5 is for explanation of the effect of the present invention.
Figure 6:
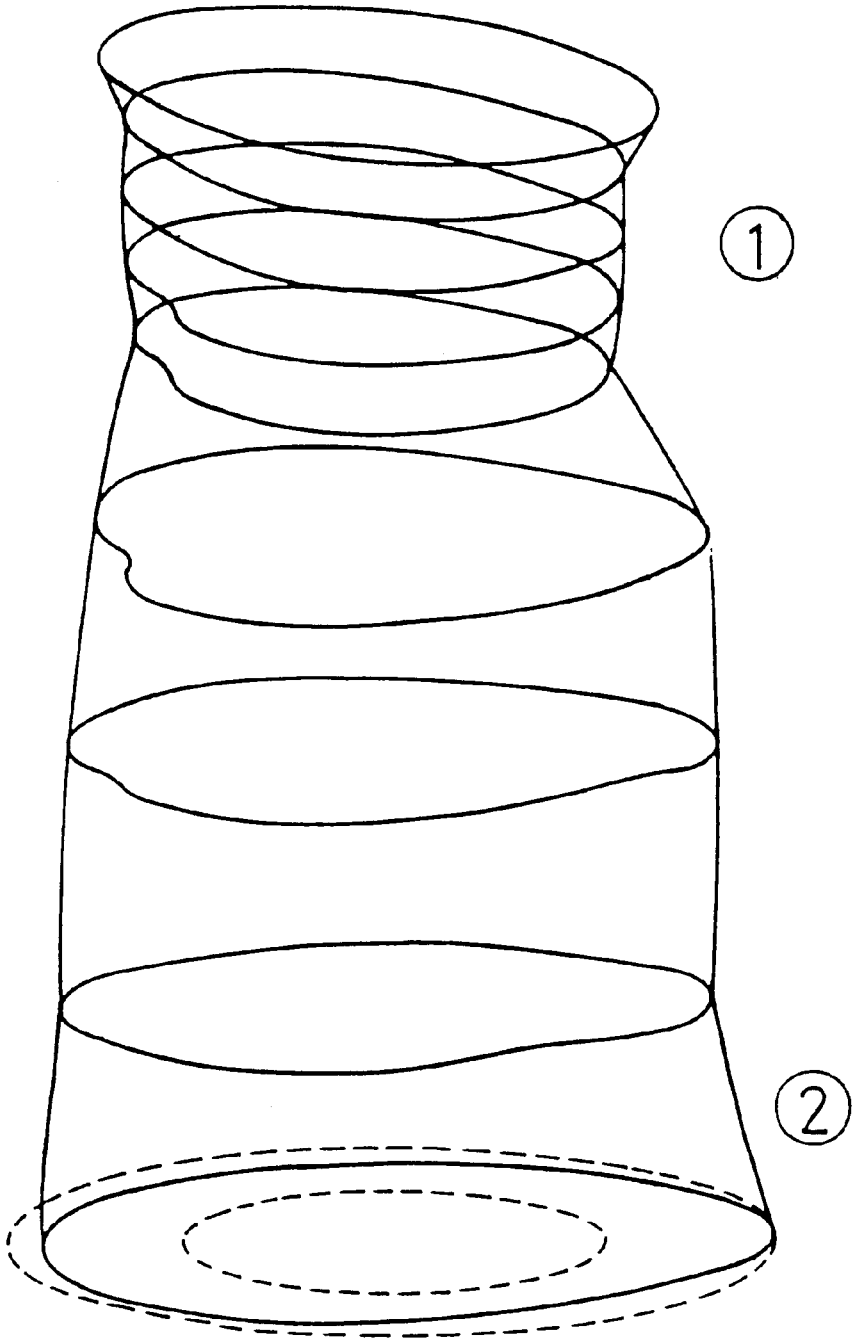
FIG. 6 is for explanation of the state of what is shown in FIG. 4.

FIG. 2 shows the case where the position of the screw portion C of the bolt 5 is more lowered. In this embodiment, since the screw portion C is located near the bolt 13 for tightening the lower case 9, where as a whole the rigidity is increased, the effect obtained from what is shown in FIG. 5 is explained and corresponds to what is shown in FIG. 6. As shown in this figure, if employing the present invention, it is understood that a bore diameter, which corresponds to the area located in the upper portion ①, where a piston stroke is located at least between an upper dead point and a lower dead point, is kept approximately in a cylinder configuration. Although, in the lower portion ② it is recognized to exist a little distortion, there may be little influence because such position is out of so-called a combustion chamber.

The location of the screw portion C of the bolt 5 is preferably to be lower than the position (lower dead position) of the piston ring which slides in the bore (in general, the vertical dimension of the water jacket is greater than the piston stroke).

Since the present invention is the cylinder structure of the internal combustion engine thus formed, although, in the conventional art, when tightening a bolt for connecting the cylinder head to the cylinder block, the tightening force has been effected merely around the vicinity of the bolt and thereby the gasket has been clamped unevenly, such problem is solved because the gasket is clamped evenly to increase the sealing property thereof. In addition, in the conventional structure, a deformation of cylinder bore has occurred to cause a lousy sound while driving, however, such problem has been improved to cause to increase the following property of the piston ring to the cylinder bore, to reduce engine oil consumption, to decrease the amount of the blow by gas generated and to lengthen the period for exchanging the engine oil.

What is claimed is:

1. A cylinder structure of an internal combustion engine in which a cylinder block and a cylinder head are fastened with a bolt coming through from a cylinder head side, wherein a cylinder bore is lined with a liner, a lower and circumferential portion of the liner is covered with a barrel, a water jacket is located around the liner, an upper portion of the water jacket is opened at a joining face between the cylinder block and the cylinder head, and said bolt is screwed within a wall of the cylinder block, in such a manner that a tip end of said bolt reaches to a portion lower than a bottom of the water jacket, where the water jacket covers an outer circumference of the liner.

* * * * *